United States Patent [19]

Foster

[11] Patent Number: 4,756,106

[45] Date of Patent: Jul. 12, 1988

[54] VEHICLE MESSAGE HOLDER

[76] Inventor: Philip H. Foster, P. O. Box 347, Indianola, Wash. 98342

[21] Appl. No.: 945,015

[22] Filed: Dec. 22, 1986

[51] Int. Cl.[4] ..... G09F 21/04

[52] U.S. Cl. ..... 40/591; 40/644; 40/490; 40/594; 40/611

[58] Field of Search ..... 40/591, 611, 490, 489, 40/10 R

[56] References Cited

U.S. PATENT DOCUMENTS

| | | | |
|---|---|---|---|
| 1,803,727 | 5/1931 | Rasmussen | 40/490 |
| 1,948,191 | 2/1934 | Shoemaker | 40/490 |
| 3,826,026 | 7/1974 | Bevan | 40/611 |
| 3,918,187 | 11/1975 | Vogele | 40/611 |
| 4,453,328 | 6/1984 | Connolly | 40/594 |

FOREIGN PATENT DOCUMENTS

| | | | |
|---|---|---|---|
| 894173 | 10/1953 | Fed. Rep. of Germany | 40/490 |

*Primary Examiner*—John J. Wilson
*Assistant Examiner*—Hakomaki J.
*Attorney, Agent, or Firm*—Christopher Duffy

[57] ABSTRACT

The message holder comprises an envelope-like case which is preferably in the form of an elongated, open-faced sheath having a slot at one end thereof through which a plate-like message carrier can be bayoneted into the pocket of the sheath. A releasable detainer such as a tab on the one end portion of the sheath, operate to retain the carrier in the pocket while a message on the same is displayed through the opening in the face of the sheath. Meanwhile, a plurality of adhesive pads on the backside of the sheath enable it to be secured to a surface of a vehicle, to serve as a holder for bumper sticker-type messages.

7 Claims, 2 Drawing Sheets

VEHICLE MESSAGE HOLDER

TECHNICAL FIELD

This invention relates to a message holder for displaying interchangeable messages, and in particular, to a message holder for displaying interchangeable bumper sticker-type messages on a vehicle.

BACKGROUND ART

As the term suggests, a bumper sticker is commonly adhered to a surface of a vehicle, such as a bumper thereof, and is left in place until the message on the same is weather beaten, out of date or in need of removal for some other reason. Then the sticker is removed, commonly by using a razor blade or the like to scrape it off of the surface and then a solvent to remove any adhesive remaining on the surface. The bumper sticker may also be removed to replace it with another sticker which has a new and more desirable message. In fact, many vehicle owners replace the messages on their vehicles at frequent intervals, and each time they are confronted with the task of scraping off the old bumper sticker and cleaning the surface under it to make room for the new sticker.

DISCLOSURE OF THE INVENTION

The present invention makes it possible to display two or more interchangeable bumper sticker-type messages on a vehicle, and to interchange them with ease and convenience, regardless of the frequency of change. It also makes it possible to interchange the messages without the necessity for mechanically removing the previous bumper sticker, and if desired, to replace one message with another disposed on the opposite side of the bumper sticker. Furthermore, each bumper sticker is tightly secured to the surface of the vehicle, notwithstanding that it is releasably detained on the same and can be removed and replaced with another bumper sticker when desired, or as indicated, reversed to display a different message on the opposite side thereof.

According to the invention, a vehicle message holder is provided comprising an envelope-like case which has opposing faces and a planar pocket therebetween that opens to the outside of the case through a slot in one edge thereof. The holder also comprises a two-sided plate-like message carrier which is adapted to be inserted in and removed from the pocket of the case through the slot thereof. The case has an opening in one face thereof which is adapted to display a message on one side of the carrier, and there are means for retaining the carrier in the pocket while the message is displayed through the opening of the case. There are also means on the other face of the case for securing the case to a surface of the vehicle.

In many of the presently preferred embodiments of the invention, the case takes the form of an elongated, open-faced sheath having a pocket therein which opens to the outside of the sheath through a slot at one end thereof. Since the letters of a message are commonly arranged in linear fashion and the line of the message is commonly disposed in a horizontal, the sheath has the advantage that it can be arranged so that the longitudinal axis of the same is oriented generally horizontally of the vehicle and the carrier can be bayoneted into one end of the sheath through the slot therein, with the message arranged on a parallel to the axis of the sheath. In such a case, moreover, the carrier cannot be readily separated from the sheath since there are means on the one end portion of the sheath whereby the carrier is releasably detained in the pocket when the longitudinal axis of the sheath is so oriented generally horizontally of the vehicle.

In certain of these presently preferred embodiments of the invention, the releasable detainer means take the form of a keeper element which is connected with the one end portion of the sheath, to extend transverse the slot, and resiliently displaceable from the path of the carrier when the carrier is inserted in and removed from the pocket of the sheath through the slot.

For example, in some embodiments, the keeper element takes the form of a tab cantilevered athwart the slot from the one end portion of the sheath, and the one end portion of the sheath is resiliently yieldable transverse the slot to enable the tab to be displaced from the path of the carrier when the carrier is inserted into the pocket through the slot, yet return the tab to the slot when the carrier is disposed in the pocket opposite the opening in the face of the sheath.

Preferably, the carrier has a notch in the end thereof corresponding to the one end of the sheath, and the notch is adapted to interengage with the tab when the tab is returned athwart the slot.

Furthermore, the sheath may have a slot in the opposing end thereof as well, and there may also be a tab on the opposing end portion thereof, and the latter portion may be adapted to yieldably bias the tab crosswise the slot at that end in the manner of the tab employed at the one end of the sheath. In this way, the carrier can be inserted in one or the other end of the sheath, and removed through the opposing end, such as by driving it out of the sheath with a finger or a tool inserted through the slot at one or the other end of the sheath.

In most presently preferred embodiments of the invention, the means for securing the case to the surface of the vehicle include a plurality of adhesive pads on the aforesaid other face of the case. The pads are commonly covered by a parting film which is removable to enable the case to be adhered to the surface of the vehicle using the pads.

BRIEF DESCRIPTION OF THE DRAWINGS

These features will be better understood by reference to the accompanying drawings which illustrate one of the presently preferred embodiments of the invention.

In the drawings.

BEST MODE FOR CARRYING OUT THE INVENTION

Figures 1, 2, 4, 5:
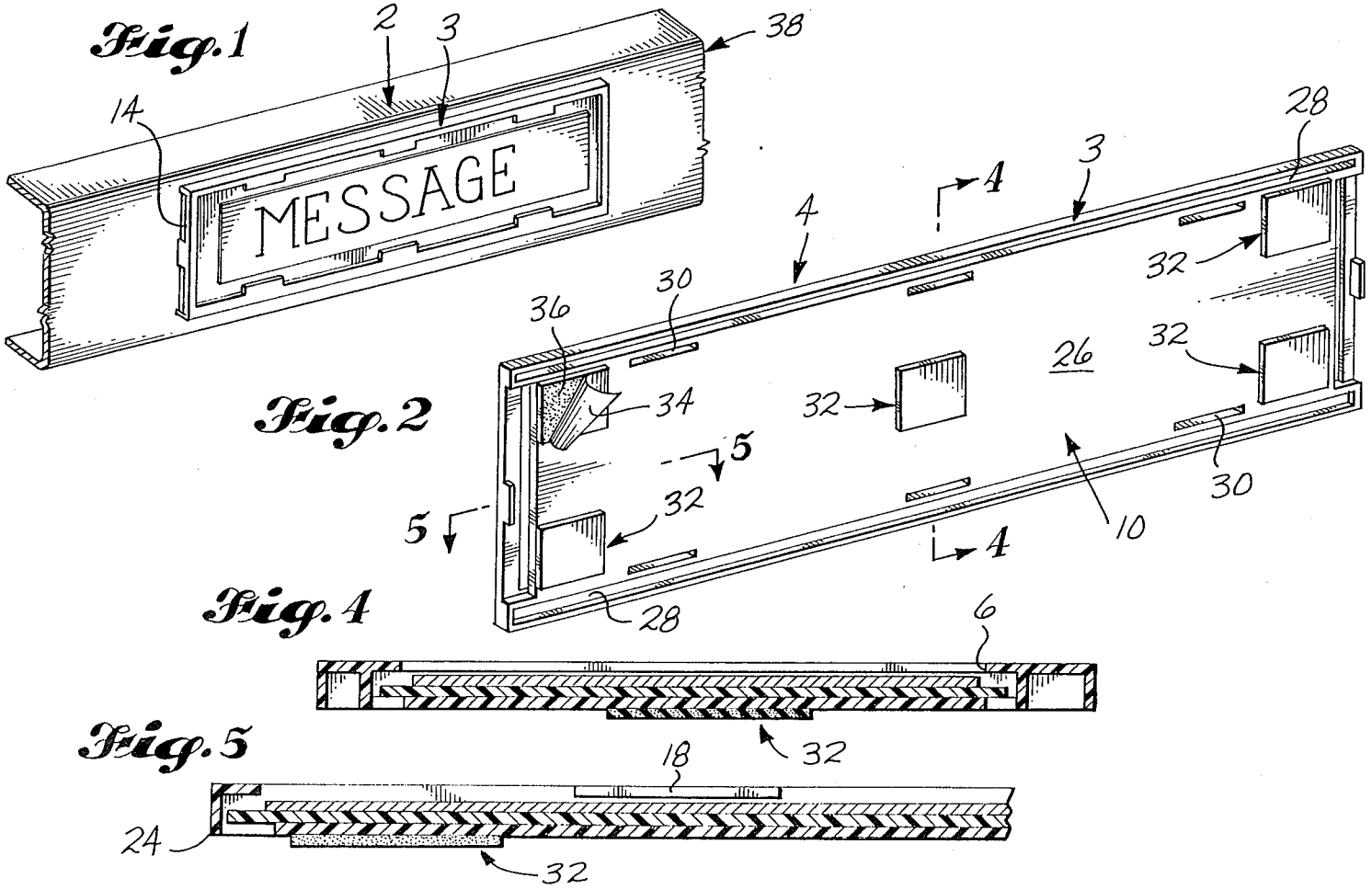
FIG. 1 is a perspective view of the message holder when it is mounted on the bumper of a vehicle.
FIG. 2 is a perspective view of the message holder, in enlarged form, as the holder is seen from the backside thereof.
FIG. 4 is a cross-sectional view of the same along the line 4—4 of FIG. 2.
FIG. 5 is a cross-sectional view of the holder along the line 5—5 of FIG. 2.

Referring to the drawings, it will be seen that the holder 2 comprises a thin, flat, elongated, orthogonal plastic sheath 3, the case 4 of which is molded into an envelope-like shape, but open faced on one side thereof. The opening 6 is elongated, rectangular and defined by a narrow rim 8 extending around the periphery of the case. The case 4 is also open ended in that the backside 10 of it terminates short of the ends 12 of the rim, and the underside of the ends is relieved widthwise of the case so that a pair of thin slots 14 is formed under the ends. The slots 14 enable a thin, flat, elongated orthogonal plate-like plastic message carrier 16 to be bayoneted into the pocket 17 of the sheath from either end of the case. The carrier 16 is received in the pocket so as to be recessed opposite the opening 6 in the plane of the slots 14. Meanwhile, there are two sets of tabs 18 projecting into the opening 6 from the longer sides 20 of the case. The tabs project into the opening along the plane of the rim, and operate to retain the carrier 16 in the sheath after it is interposed between the ends 12 of the rim 8. In addition, there are mutually opposing notches 22 in the ends of the carrier 16, and the rim of the case has a pair of mutually opposing tabs 24 cantilevered from the ends 12 of the same, crosswise of the slots 14. The plastic of the case is relatively rigid in itself, but because of its thinness, the ends 12 of the rim have sufficient flexibility that either can be flexed in the direction away from the backside of the case, to enable the carrier 14 to be inserted thereunder while the tab 24 on the end of the rim is sprung out of the plane of the pocket. Subsequently, when the carrier is interposed between the ends 12 of the rim, the flexed end 12 has sufficient resiliency that it returns the tab 24 to its position athwart the path of the carrier, where it engages in the notch 22 thereadjacent. At the same time, the tab 24 on the opposing end 12 of the rim engages in the notch 22 on the corresponding end of the carrier, so that the carrier is releasably detained between the tabs 24 until one or the other tab is lifted and the carrier is driven out of the pocket through that end of the case.

Figure 3:
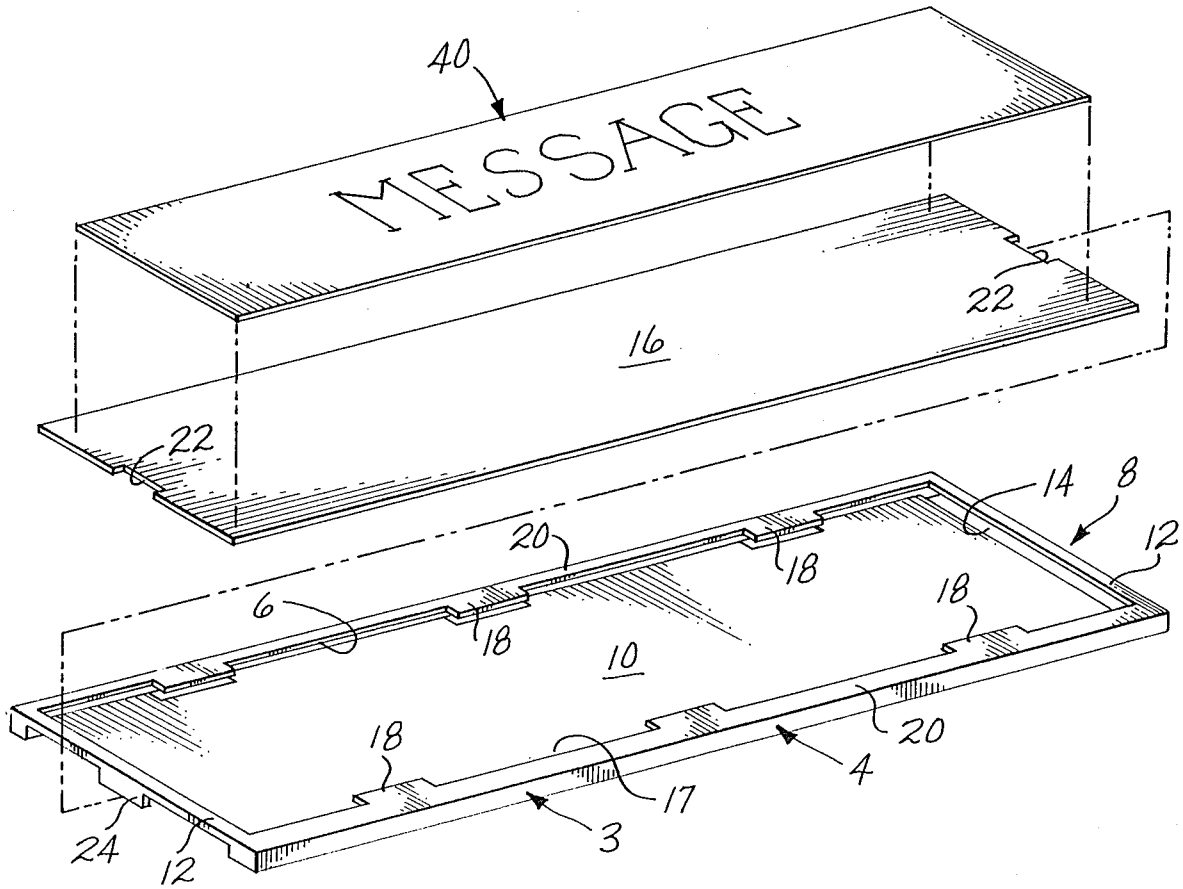
FIG. 3 is an exploded perspective view of the holder.

The backside 10 of the case has a plain surface at the pocket, but the opposing side 26 of it has a pair of elongated grooves 28 therein, running under the longer sides of the rim. It also has grooves 30 therein, corresponding to the locations of the tabs 18. All of these features result from the molding of the case 4 and are not essential to the embodiment itself. However, as seen in FIG. 3, the grooves 30 open to the pocket in the manner of slots and allow air and dirt to exit from the pocket as the carrier is inserted therein.

Also, in addition to these features on the reverse side 26 of the case, there are five adhesive coated pads 32 at the corners and center of the same. Each of the pads has a parting film 34 thereover, but when the holder 2 is put to use, the parting films 34 are removed to expose the adhesive coatings 36 on the pads. The pads 32 are then used to adhere the holder to a surface of the car, such as the bumper 38 seen in FIG. 1. Moreover, a message 40 is adhered or otherwise secured to one side of the carrier 16, before it is bayoneted into the case as described earlier. If desired, a further message (not shown) may be applied to the opposing side of the carrier before it is bayoneted into the case; and at a time thereafter, if desired, the carrier may be removed, reversed and reinserted to display the alternative message.

New carriers 16 are commonly provided to display additional messages, so that there is seldom any necessity to remove and replace a message before the holder can be put to use.

In addition, if desired, the carrier 16 can be used as a blank when the sheath is out of use as a message holder.

I claim:

1. A message holder for displaying interchangeable bumper sticker-type messages on a vehicle, comprising:

an envelope-like case which is rectangular in outline and has opposing faces and a planar pocket of similar outline therebetween that opens to the outside of the case through a pair of slots in the opposing end edges thereof, and a two-sided plate-like message carrier which is also rectangular in outline and is adapted in size and sufficiently rigid that it can be bayonetted endwise into and out of the pocket of the case through the slots in the opposing end edges thereof, the case having an opening in one face thereof which is adapted to display a message on one side of the carrier, means for retaining the carrier in the pocket while the message is displayed through the opening of the case, and means for securing the case to a surface of the vehicle opposite the other face of the case, the carrier being adapted to be enclosed in its entirety within the pocket when it is inserted therein, and the slots being coplanar with the plane of the pocket so that when the carrier is to be inserted in the pocket, the carrier can be placed in the plane of the pocket and then bayonetted into the pocket through one of the slots, to register the message with the opening in the one face of the case, and when the carrier is to be removed from the pocket, it can be driven out of one or the other of the slots, in the plane of the pocket, and the retainer means being connected with the opposing end edge portions of the case to extend athwart the plane of the pocket adjacent the slots, but being resiliently yieldable transverse the plane of the pocket so that they are displaceable from the path of the carrier when the carrier is inserted into and removed from the pocket, yet will reposition themselves athwart the plane of the pocket to retain the carrier in the pocket when it is enclosed within the same.

2. The message holder according to claim 1 wherein the retainer means have a width of less than that of the carrier and the slots in the plane of the pocket.

3. The message holder according to claim 1 wherein the retainer means take the form of a pair of keeper elements cantilevered athwart the plane of the pocket from the opposing end edge portions of the case; and wherein the opposing end edge portions of the case, in one or the other face thereof, are resiliently yieldable transverse the plane of the pocket to enable each of the keeper elements to be relatively displaced from the path of the carrier when the carrier is inserted into the pocket through one or the other of the slots, yet are operable to return the respective keeper element to its position athwart the plane of the pocket when the carrier is enclosed within the pocket.

4. The message holder according to claim 3 wherein the carrier has notches in the opposing end edges thereof, and the notches are adapted to interengage with the keeper elements when the respective elements are returned to their positions athwart the plane of the pocket.

5. The message holder according to claim 1 wherein the means for securing the case to the surface of the vehicle include a plurality of adhesive pads on the aforesaid other face of the case.

6. The message holder according to claim 1 wherein the case takes the form of an elongated, open-faced sheath having a planar pocket therein which opens to the outside of the sheath through slots in the opposing end edges thereof; and wherein there are tabs cantilevered athwart the plane of the pocket from the opposing end edges of the sheath, the opposing end edge portions of the case, in one or the other face thereof, being resiliently yieldable transverse the plane of the pocket to enable each of the tabs to be relatively displaced from the path of the carrier when the carrier is inserted into the pocket through one or the other of the slots, yet are operable to return the respective tab to its position athwart the plane of the pocket when the carrier is enclosed with the pocket.

7. In combination, a vehicle, and a message holder for displaying interchangeable bumper sticker-type messages on the vehicle, comprising:

an envelope-like case which is rectangular in outline and has opposing faces and a planar pocket of similar outline therebetween that opens to the outside of the case through a pair of slots in the opposing end edges thereof, and a two-sided plate-like message carrier which is also rectangular in outline and is adapted in size and sufficiently rigid that it can be bayonetted endwise into and out of the pocket of the case through the slots in the opposing end edges thereof, the case having an opening in one face thereof which is adapted to display a message on one side of the carrier, means for retaining the carrier in the pocket while the message is displayed through the opening of the case, and means securing the case to a surface of the vehicle opposite the other face of the case, the carrier being adapted to be enclosed in its entirety within the pocket when it is inserted therein, and the slots being coplanar with the plane of the pocket so that when the carrier is to be inserted in the pocket, the carrier can be placed in the plane of the pocket and then bayonetted into the pocket through one of the slots, to register the message with the opening in the one face of the case, and when the carrier is to be removed from the pocket, it can be driven out of one or the other of the slots, in the plane of the pocket, and, the retainer means being connected with the opposing end edge portions of the case to extend athwart the plane of the pocket adjacent the slots, but being resiliently yieldable transverse the plane of the pocket so that they are displaceable from the path of the carrier when the carrier is inserted into and removed from the pocket, yet will reposition themselves athwart the plane of the pocket to retain the carrier in the pocket when it is enclosed within the same.

* * * * *